US009663948B2

(12) United States Patent
Lehane et al.

(10) Patent No.: US 9,663,948 B2
(45) **Date of Patent: *May 30, 2017**

(54) FREE SPAN CEILING GRID SYSTEM

(71) Applicant: USG Interiors, LLC, Chicago, IL (US)

(72) Inventors: James J. Lehane, McHenry, IL (US); Lee M. Tedesco, Shorewood, IL (US); Peder J. Gulbrandsen, Aurora, IL (US); John M. Willi, Westlake, OH (US); Donald J. Leahy, North Olmsted, OH (US); Abraham M. Underkofler, Waukegan, IL (US); Yelena Straight, North Buffalo Grove, IL (US); Michael O'Donnell, Modesto, CA (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/969,607

(22) Filed: Dec. 15, 2015

(65) Prior Publication Data

US 2016/0102454 A1 Apr. 14, 2016

Related U.S. Application Data

(63) Continuation of application No. 14/462,716, filed on Aug. 19, 2014, now Pat. No. 9,255,403.

(51) Int. Cl.
*E04B 9/30* (2006.01)
*E04B 9/12* (2006.01)
(Continued)

(52) U.S. Cl.
CPC ..... *E04B 9/30* (2013.01); *E04B 9/001* (2013.01); *E04B 9/008* (2013.01); *E04B 9/067* (2013.01);
(Continued)

(58) Field of Classification Search
CPC ... E04B 9/30; E04B 9/127; E04B 9/10; E04B 9/34; E04B 9/001; E04B 9/008; E04B 9/067; E04B 9/068; E04B 9/16; E04B 2009/186
USPC ..... 52/712, 506.07, 655.1, 506.06, 167.1; 248/316.7, 221.11, 317, 343, 320.1, 248/222.14
See application file for complete search history.

(56) References Cited

U.S. PATENT DOCUMENTS 2,229,064 A 1/1941 Finch
3,035,672 A 5/1962 Tuten et al.
(Continued)

FOREIGN PATENT DOCUMENTS

FR 2740800 A1 5/1997
JP 3172951 U 1/2012
JP 2013-238026 A 11/2013

OTHER PUBLICATIONS

"Corridor Installations and the Armstrong SingleSpan Solution" brochure, 10 pgs., Copyright 2011 AWI Licensing Company.
(Continued)

*Primary Examiner* — Brent W Herring
(74) *Attorney, Agent, or Firm* — Pearne & Gordon LLP

(57) ABSTRACT

Components for constructing a ceiling grid across a span free of or with a limited number of suspension wires including main runners with a relatively high moment of inertia secured at their ends with brackets to wall moldings on opposing walls.

7 Claims, 5 Drawing Sheets

(51) Int. Cl.

| | |
|---|---|
| ***E04B 9/06*** | (2006.01) |
| ***E04B 9/00*** | (2006.01) |
| ***E04B 9/34*** | (2006.01) |
| ***E04B 9/10*** | (2006.01) |
| *E04B 9/18* | (2006.01) |
| *E04B 9/16* | (2006.01) |

(52) U.S. Cl.

CPC ..... *E04B 9/10* (2013.01); *E04B 9/127* (2013.01); *E04B 9/34* (2013.01); *E04B 9/068* (2013.01); *E04B 9/16* (2013.01); *E04B 2009/186* (2013.01)

(56) References Cited

U.S. PATENT DOCUMENTS

| | | | | |
|---|---|---|---|---|
| 3,798,865 | A | 3/1974 | Curtis | |
| 5,195,289 | A | 3/1993 | LaLonde et al. | |
| 5,572,844 | A | 11/1996 | Stackenwalt et al. | |
| 5,937,605 | A | 8/1999 | Wendt | |
| 6,018,923 | A | 2/2000 | Wendt | |
| 6,138,425 | A | 10/2000 | Wendt | |
| 6,213,679 | B1 * | 4/2001 | Frobosilo | E04B 2/82 403/14 |
| 6,298,623 | B1 | 10/2001 | Wendt | |
| 6,612,087 | B2 | 9/2003 | diGirolamo et al. | |
| 7,104,024 | B1 | 9/2006 | diGirolamo et al. | |
| 7,240,460 | B2 | 7/2007 | Platt | |
| 7,293,393 | B2 | 11/2007 | Kelly et al. | |
| 7,552,567 | B2 | 6/2009 | Ingratta et al. | |
| 7,690,168 | B2 * | 4/2010 | LaLonde | E04B 9/30 52/220.6 |
| 7,788,875 | B2 | 9/2010 | Wendt | |
| 7,930,864 | B2 | 4/2011 | Wendt | |
| 8,763,336 | B2 | 7/2014 | Gulbrandsen et al. | |
| 8,813,457 | B2 | 8/2014 | Underkofler et al. | |
| 9,255,403 | B1 * | 2/2016 | Lehane | E04B 9/067 |
| 2005/0081467 | A1 | 4/2005 | Fontaine | |
| 2005/0160696 | A1 | 7/2005 | Kelly et al. | |
| 2007/0022690 | A1 * | 2/2007 | LaLonde | E04B 9/30 52/506.07 |
| 2009/0301010 | A1 | 12/2009 | Kelly et al. | |
| 2010/0257807 | A1 | 10/2010 | Raheel et al. | |
| 2012/0042584 | A1 | 2/2012 | Sareyka | |
| 2013/0160386 | A1 | 6/2013 | Gulbrandsen | |
| 2016/0053488 | A1 * | 2/2016 | Lehane | E04B 9/067 52/167.1 |

OTHER PUBLICATIONS

International Search Report and Written Opinion of the International Searching Authority dated Nov. 5, 2015, issued in PCT/US2015/043907, filed Aug. 6, 2015.

* cited by examiner

FREE SPAN CEILING GRID SYSTEM

This application is a continuation of U.S. application Ser. No. 14/462,716, filed Aug. 19, 2014.

BACKGROUND OF THE INVENTION

The invention relates to suspended ceilings and, in particular, to grid elements that eliminate or reduce the number of mid-span suspension wires or like elements required to adequately support the ceiling assembly.

PRIOR ART

Commonly, the grid of a suspended ceiling is supported by wires depending from overhead structure such as an overlying floor or roof. There are circumstances, as in corridors, where the plenum or space above the ceiling is occupied by utilities, such as air and wire ducts, making it difficult or impractical to use wires for carrying the weight of a ceiling. In other circumstances, there may only be a limited number of places to attach wires to the overhead structure and/or to the grid elements. In still other circumstances, labor and overall installation costs can be lowered where the number of wires needed for an installation is reduced.

There have been proposals such as disclosed in U.S. Pat. No. 7,240,460 and U.S. patent publication US 2010/0257807A1 for free span suspended ceilings.

SUMMARY OF THE INVENTION

The invention provides a ceiling grid system with high moment of inertia grid runner, end brackets and wall mounted runner end supports. Optional elements of the system include splice plates and runner-to-runner cross hanger brackets. The disclosed system is capable of spanning an area without or with limited overhead wire support.

In the disclosed embodiment, the high moment of inertia grid runners are primarily used as main runners or tees that cooperate with cross runners in a generally conventional manner. End brackets are manually attached to main runners typically at the grid installation site after the main runners are confirmed to fit or have been cut to fit the span across which they are to be installed.

Preferably, an end bracket interfits with the physical characteristics of the main runner so that only a single screw fastener is required to rigidly fix the bracket to the runner.

The disclosed grid runner end supports are in the form of roll formed sheet metal channels that are affixed to the walls at the edge of the ceiling. The channel flanges can be of different widths so that the channel can be oriented with a wide or narrow flange visible from the space below the ceiling. The flanges have inturned hems that are engaged by tab elements of the end brackets for a quick snap-in provisional mounting. An end bracket can be locked on the channel at a desired location with a screw fastener through a web of the channel.

In moderate span length applications such as in a corridor of 8 foot (or metric equivalent) for an acoustical ceiling, the disclosed system can eliminate the need for intermediate overhead support wires or like members. In longer spans, the system can reduce the number of suspension wires that would otherwise be required. For such longer spans, a splice plate is provided to enable the high moment of inertia grid runner to be connected end-to-end. Additionally, the splice plate can be bent into a right angle for connecting intersecting grid runners to the main runner.

A cross brace clip is disclosed that suspends a high moment of inertia grid runner with an identical grid runner to reduce the number of necessary suspension wires and/or enable a main runner to be suspended where no directly overhead structure is available for its support.

DESCRIPTION OF THE PREFERRED EMBODIMENT

Figure 1:
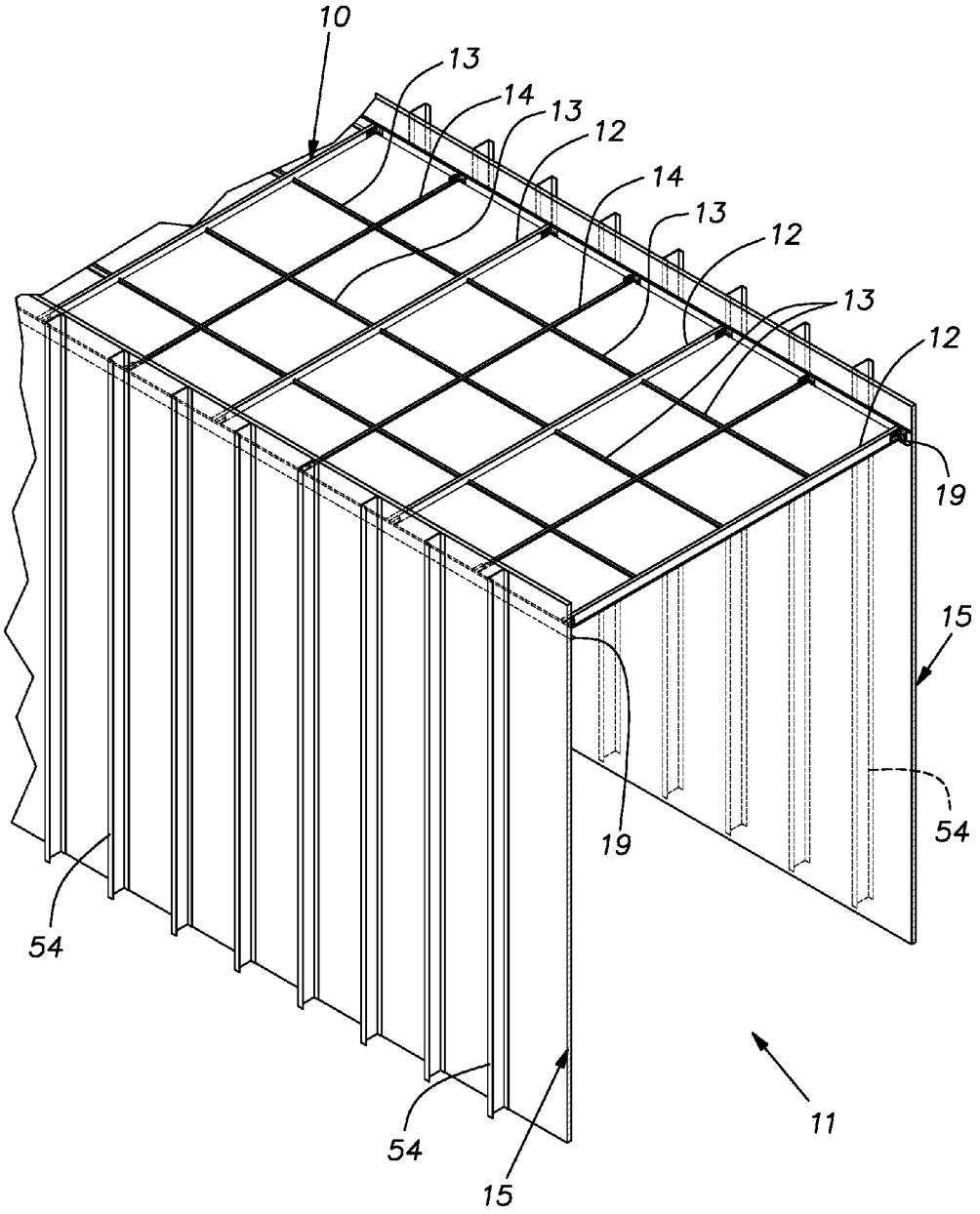
FIG. 1 is a schematic perspective view of a corridor ceiling embodying aspects of the invention.

FIG. 1 illustrates a suspended ceiling grid 10 suitable for supporting conventional acoustical panels or tiles in a corridor 11. It will be understood that various aspects of the invention are applicable to suspended ceilings apart from hallways or corridors and the like. By way of example, the corridor 11 can be nominally 8 foot in width (or metric equivalent). The grid 10 comprises parallel main runners 12 located on 4 foot centers. Cross runners 13, nominally 4 foot long, extend transversely between the main runners 12. Nominal 2 foot cross runners 14 are disposed between cross runners 13.

As is conventional, cross runners 13, 14 have end connectors assembled in receiving slots 17 of the main runners 12 and cross runners 13. Ends of the main runners 12 and cross runners 14 are supported by wall channels 19.

The main runners 12 have the general cross section of an inverted tee with a hollow upper generally oval reinforcing bulb 21, a vertical web 22 depending from the bulb, and a flange 23 symmetrically disposed about a lower edge of the web. The illustrated bulb 21 is substantially wider than it is tall. By way of example, but not limitation, the main runner 12 can have a height of about 2¾ inch which, when compared to a typical 1.640 inch height conventional intermediate duty main grid runner, is relatively tall. The height of the main runner 12, width of its reinforcing bulb 21 and heavier gauge results in a runner that has a high moment of inertia about its longitudinal bending axis. Consequently, the runner 12 can support a relatively high load distributed along its length. For example, the main runner 12, formed of 0.022 inch thick G-30 hot-dipped galvanized steel place on 4 foot centers such as is shown in FIG. 1 can readily support an acoustical ceiling of conventional tile. The illustrated main runner 12 can support 12 pounds per foot across a span of 8 foot without intermediate support wires, straps, rods or the like.

Figure 2:
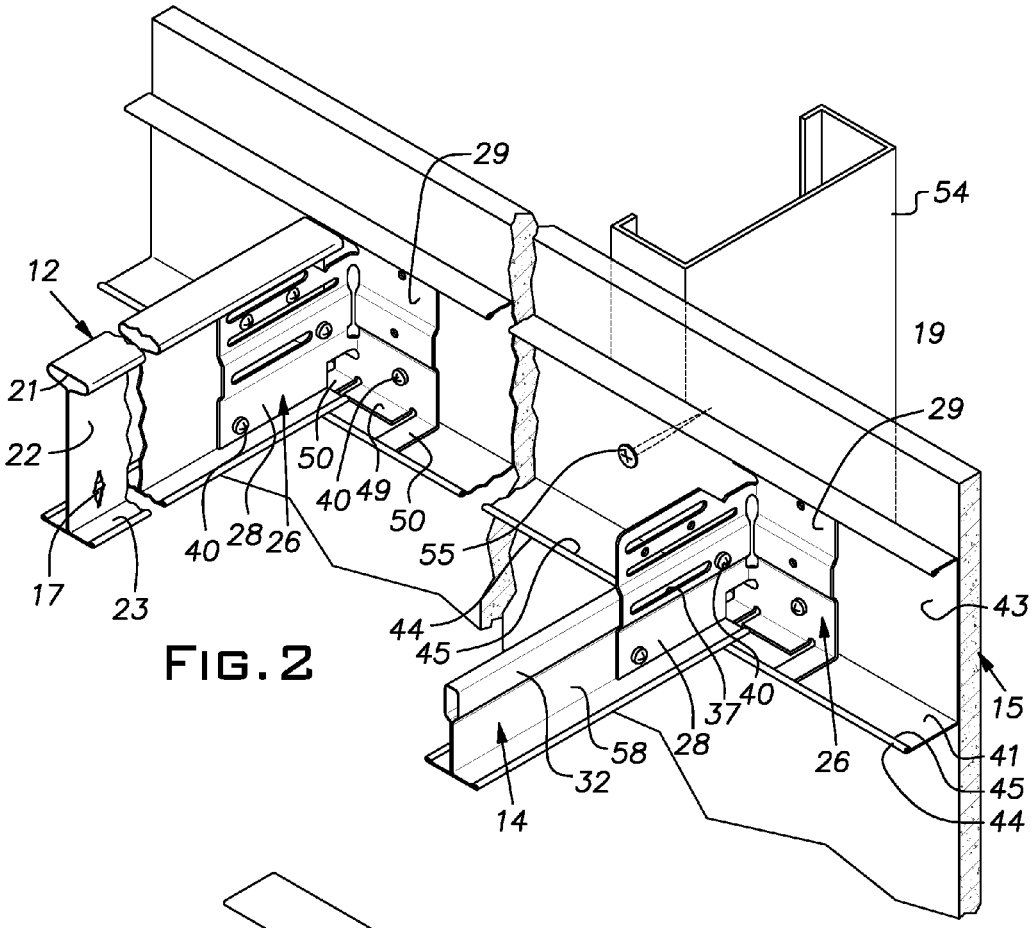
FIG. 2 is an enlarged fragmentary perspective view of an end area of grid runners and a support channel of FIG. 1.
Figure 6:
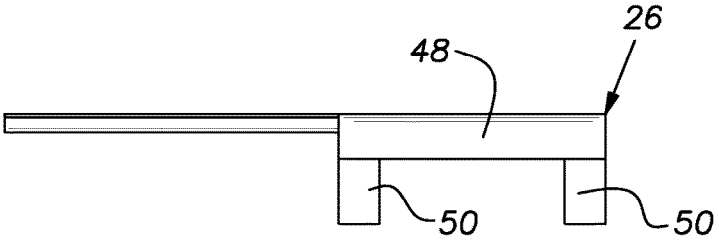
FIG. 6 is a top view of the clip of FIG. 4.
Figure 4:
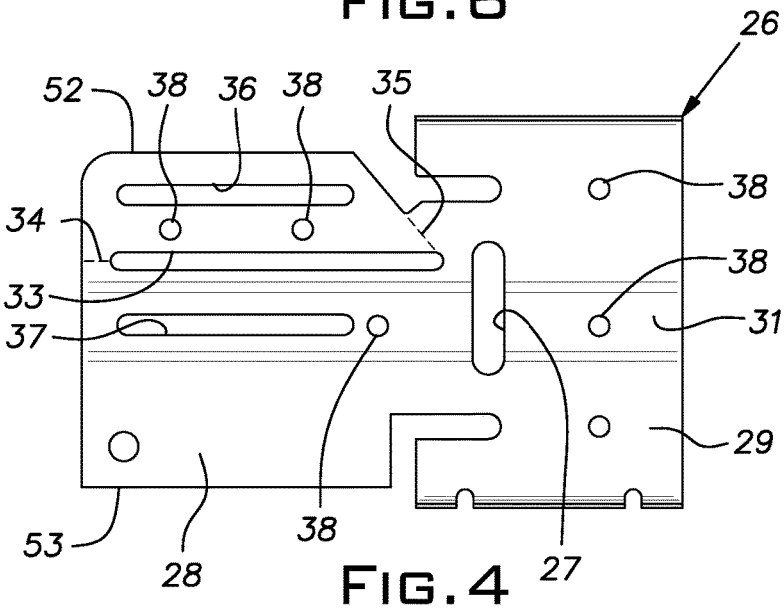
FIG. 4 is an elevational view of an end clip for a main runner shown in a pre-bent condition.
Figure 5:
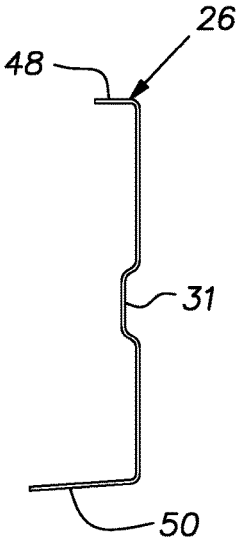
FIG. 5 is an edge view of the clip of FIG. 4.

The ceiling load on a main tee 12 is transferred at each end to a respective wall channel 19 through an end bracket 26. The end bracket 26 is shown separately in FIGS. 4-6 and with main and cross runners 12, 13 in FIGS. 2 and 3. The end bracket 26 is preferably a sheet metal stamping. The bracket 26 can be marketed in the generally flat configuration illustrated in FIGS. 4-6 making it easier for a technician to carry a plurality of the brackets in a pouch or box. For use, the technician manually bends the bracket 26 across a vertical line determined by a center line of a vertical slot 27 that serves locally to weaken the bracket for this bending purpose. A portion 28 of the bracket 26 to the left of the slot 27 in FIG. 4 is engageable with a main grid runner 12 and a portion 29 to the right is engageable with a wall channel 19. The bracket 26 has a central horizontal shallow channel 31 with an elevation and width enabling it, on the left portion 28 to register with a reinforcing bulb 32 of a conventional grid runner of nominal 1½ inch height as shown in FIG. 2. A narrow horizontal slot 33 enables an upper region of the left bracket portion 28 to be removed for clearance purposes by cutting the region off at the dotted lines 34, 35. Two other horizontal slots 36, 37 can be used in a seismic application with a screw located in either slot and an associated grid runner. Holes 38 are provided to receive screw fasteners for fixing the bracket 26 to a grid runner 12, 13 and to the web of a wall channel 19.

The wall channel 19 is preferably roll formed of sheet metal of, for example, G-30 hot dipped galvanized steel of 0.020 inch thickness. The illustrated channel 19 has flanges 41, 42 of different widths and extending generally perpendicularly from a common web 43. The wider flange 41 is, for example, nominally 1 inch wide and the narrow flange 42 is nominally ½ inch wide. These flange dimensions correspond to the flange face width of standard and narrow face commercially available grid common in the industry. The channel flanges 41, 42 have inturned hems 44 associated with marginal edges 45 of the metal strip forming the channel 19. The flanges 41, 42 are spaced to receive the height of the main runner 12.

As shown in FIG. 1, the channels 19 are secured to a wall 15 at ceiling height with one of their flanges 41 or 42 at or essentially at the plane of the grid surfaces which remain visible when ceiling tile are installed on the grid flanges. The other flange 42 or 41 is situated above this visible plane. The main runners 12 may be supplied with a length that exceeds a standard corridor width. For example, if the corridor under construction has a nominal 8 foot width, main runners 12 can be provided at a length of 8 foot 6 inches, so that any actual run out of the corridor can be accommodated. End brackets 26 are field installed on the main runners 12 so that the main runners can be first properly cut to length, typically at each end, to center the grid 10 as dictated by slots 17 in the main runners. The cross runner connector receiving slots 17 (FIG. 2) are spaced along the length of the main runner 12 on, for example, 6 inch centers.

The end brackets 26 have resilient tabs 48-50 on upper and lower edges of the channel engaging portion 29. The upper tab 48 extends the full length of the portion 29 and a lower middle tab 49 extends between outlying lower tabs 50. With reference to FIG. 2, the outlying lower tabs 50 are proportioned to snap into engagement with the inner edges 45 of the hem 44 of the wide channel flange 41 and the upper tab 48 is proportioned to snap into engagement with the narrow flange hem edge 45 when the bracket portion 29 is pushed into the channel 19. This snap fit is a convenience to the installer since the bracket 26 (and the main runner 12 if it is attached) is/are immediately held in the channel while being horizontally adjustable. When in a proper position, the bracket 26 is fixed to the channel web 43 with a self-drilling screw 40 or other suitable fastener through a hole 38 in the portion 29. The bracket 26 can be fixed to a main runner 12 with a single self-drilling screw 40. Upper and lower edges 52, 53 of the runner engaging portion 28 of the end bracket as shown in the drawings, lie on straight lines extending a major part of the horizontal length of the portion and are proportioned to fit closely with the bottom of the reinforcing bulb 21 and top of the flange 23 when positioned against the main runner web 22. When held against the web 22 by a single self-drilling screw 40 or other fastener positioned in a hole 38, the bracket 26 cannot perceptibly rotate relative to the main runner 12 and, consequently, the main runner cannot droop at the bracket under the weight of the ceiling.

Typically, the channel 19 is secured to a wall by self-drilling drywall screws 55 (FIG. 2) through the channel web 43, any wall facing material such as drywall, and into studs 54. An upper flange 42 or 41 of the channel 19 stiffens the channel web 43 and prevents it from pulling away from the wall to which it is attached due to the weight of the ceiling. Consequently, there is no need to align a bracket 26 or, more importantly, a grid runner 12, with a wall stud 54 (FIG. 1) so that the bracket would be anchored directly to a stud.

From the foregoing, it will be seen that for the spans of about 8 feet the runners 12 and the acoustical ceiling elements they carry are supported exclusively at their ends. The brackets 26 are capable of fully providing this support although a support contribution can be provided by a lower channel flange 41 or 42.

Figure 3:
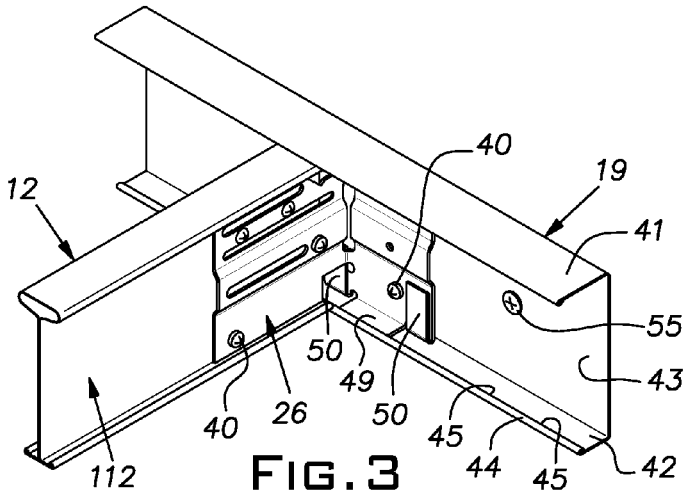
FIG. 3 is an enlarged fragmentary perspective view of a main grid runner with a narrow lower flange and a support channel inverted from that shown in FIG. 2.

In FIG. 3, a main runner 112 has a narrow flange face as would the other main and cross runner in a ceiling installation. The wall channel 19 is inverted from its position in FIG. 2. In this orientation, the narrow flange 42 will be visible from below and will match the appearance of the grid runners where they are of the narrow face design. In instances where the wall channel 19 is of the orientation in FIG. 3, the end bracket tabs 50 are bent up by the installer and the middle tab 49 can engage the adjacent hem edge 44 of the narrow flange 42.

In the foreground of FIG. 2 is illustrated the end bracket 26 supporting a conventional cross runner 14. The horizontal channel 31 is proportioned to receive a reinforcing bulb 32 of the runner 14 while a lower part of the portion 28 abuts a web 58 of the runner. For seismic service, a screw can be positioned in the slot 37 and the reinforcing bulb.

Figure 7:
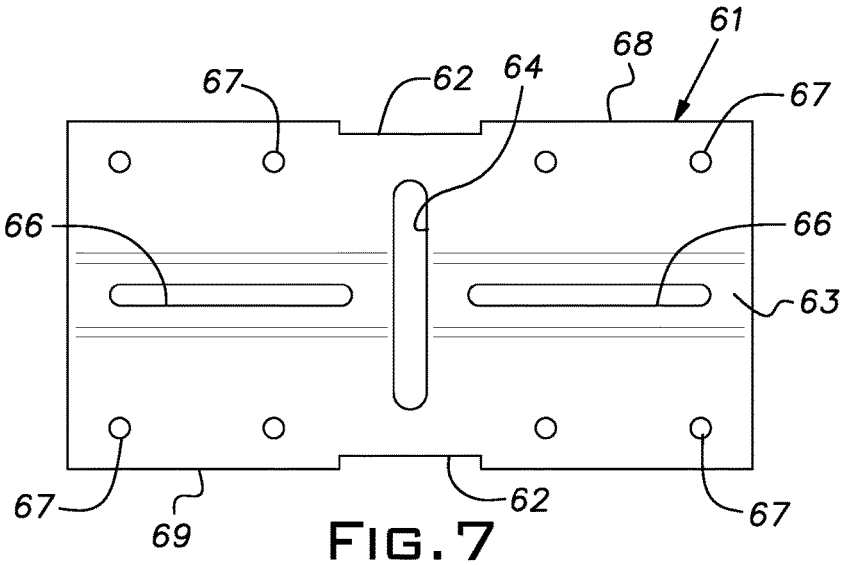
FIG. 7 is an elevational view of a splice plate for the main runner.
Figure 8:
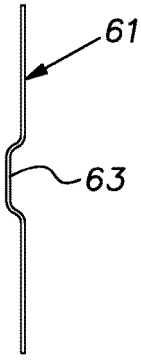
FIG. 8 is an edge view of the splice plate of FIG. 7.
Figure 9:
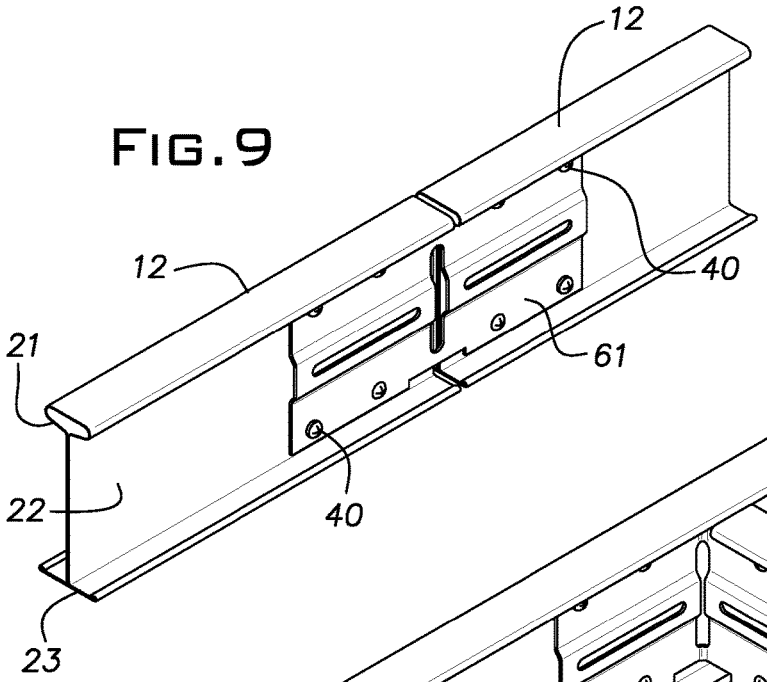
FIG. 9 is a fragmentary perspective view of two main runners joined with the splice plate of FIG. 7.
Figure 10:
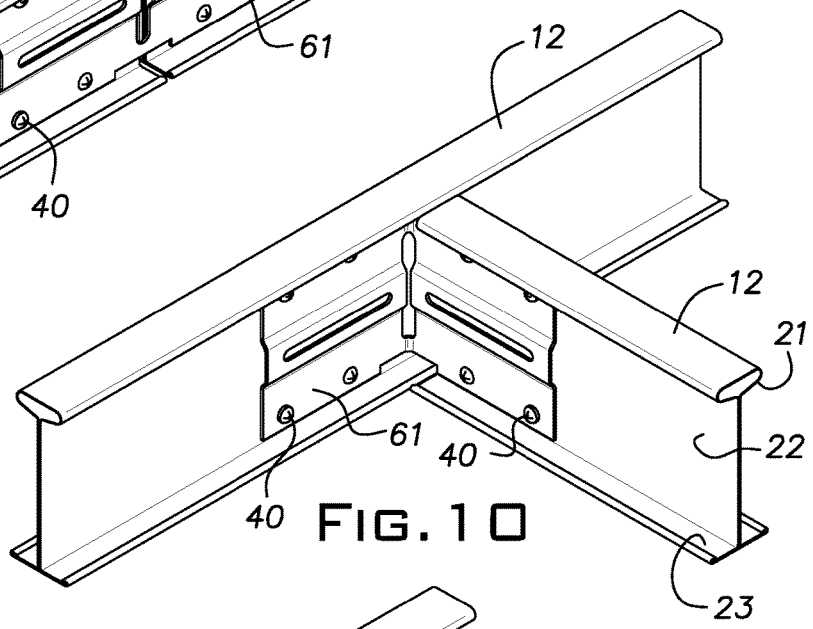
FIG. 10 is a perspective view of main runners intersecting at 90 degrees and joined by the splice plate of FIG. 7.

FIGS. 7 and 8 illustrate a splice plate 61 useful for joining the ends of a pair of main runners 12 in the manners illustrated in FIGS. 9 and 10. The splice plate 61 is generally rectangular in front view, being formed, for example, of 0.030 inch gauge hot-dipped galvanized steel sheet. The plate 61 has notches 62 along its upper and lower edges at its mid-section. A shallow horizontal rib or channel 63 is stamped in the body of the plate 61. A central vertical slot forms a line of weakness to permit the plate 61 to be manually bent into a right angle. Elongated horizontal slots 66 are stamped in the plate channel 63 on both sides of the vertical slot 64. Several holes 67 are provided for screws used to attach the plate to a grid runner. FIG. 9 illustrates the plate 61 joining a pair of main runners 12 together in end-to-end alignment. Upper and lower edges 68, 69 of the plate 61 fit closely between the reinforcing bulb 21 and the flange 23 when the plate is abutted against the web 22 of a main runner 12. The fit of the plate 61 thereby prevents any perceptible rotational movement relative to the main runner to which it is attached. Any of the holes 67 or slot 66 may be used to accept a screw for attaching the plate to a main runner 12.

FIG. 10 illustrates use of the plate 61 to join a main runner 12 with an intersecting main runner. Note that the width of the slot 64 avoids interference between areas of the channel 63 when the plate 61 is bent into a right angle.

Figure 11:
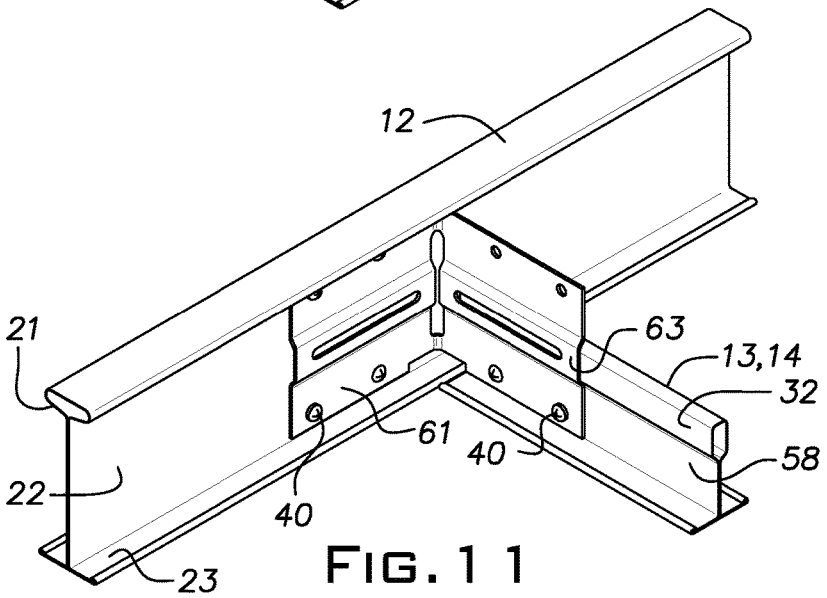
FIG. 11 is a view similar to FIG. 10 with a cross-runner joined to a main runner with the splice plate of FIG. 7.

FIG. 11 illustrates use of the splice plate 61 to join a main runner 12 with an intersecting conventional cross runner 13 or 14. The channel 63 is configured to receive the reinforcing bulb 32 and a lower part of the plate half to abut the web 58 of the conventional grid runner.

Figure 12:
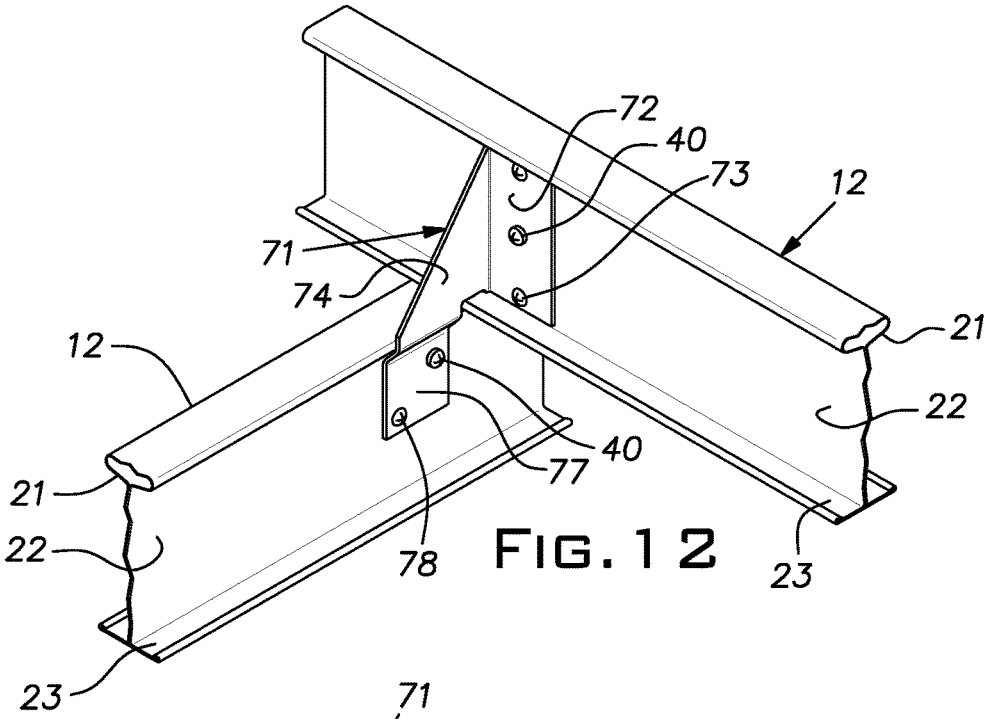
FIG. 12 is a perspective view of a cross brace clip for supporting a main runner from an identical transverse main runner.
Figure 15:
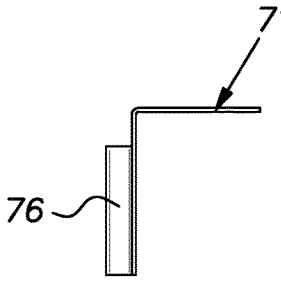
FIG. 15 is a top view of the cross brace clip.
Figure 13:
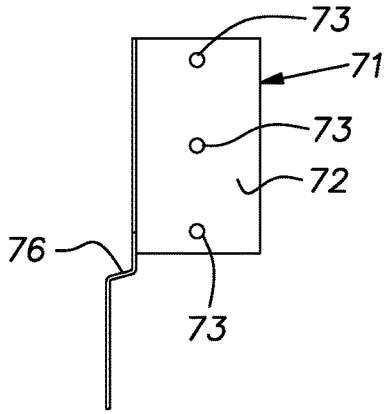
FIG. 13 is a front view of the cross brace clip.
Figure 14:
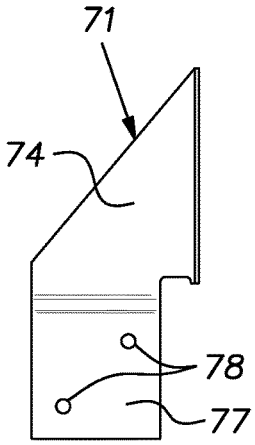
FIG. 14 is a side view of the cross brace clip.

A physical situation may exist where a main runner 12 cannot be supported exclusively at its end. For example, may be an absence of a suitable attachment point for a suspension wire or strap overlying the main runner or runners involved. FIG. 12 illustrates a cross brace clip 71 that can be useful in such situations. The clip 71, shown in detail in FIGS. 13-15, is a monolithic sheet metal stamping of, for example, 0.050 inch hot dipped galvanized steel. The clip 71 has the general geometry of a right angle. An upper planar part 72 of the clip 71 has several holes 73 for receiving self-drilling screws for attachment to the web 22 of a main runner 12. Upper and lower edges of the part 72 are spaced to closely fit between the reinforcing bulb 21 and flange 23 of a main runner 12 so that the part cannot perceptively rotate relative to the main tee when it abuts the web 22. The clip 71 includes a triangular extension 74 in a vertical plane perpendicular to the planar part 72. An offset web 76 joins the extension 74 to a depending planar part 77. Holes 78 in the depending planar part 77 receive self-drilling screws for attachment to the web 22 of a main runner 12 below and transverse to the main runner to which the upper planar part 72 is attached. It will be seen from FIG. 12 that the cross brace clip 71 supports the lower main runner 12 from the overlying main runner 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling grid comprising a plurality of parallel regularly spaced runners, each one of a pair of opposed oppositely facing channels being disposed adjacent one end of said runners, said channels each having a vertical web and a horizontal flange at top and bottom edges of the web, a bracket at each end of each runner, each bracket being attached to a respective runner with a first self-drilling screw and having a portion disposed between the flanges attached to the web of the adjacent channel with a second self-drilling screw, each runner extending in one piece between said channels, one end of each runner being exclusively supported by the adjacent channel with sufficient support capacity including a stiffening of the respective web by the respective top flange to permit the runners to support a conventional acoustical ceiling while being free of multiple suspension wires or other overlying support elements along a full length of the runners between the channels, each grid runner having an upper reinforcing bulb and a lower flange, the bracket fitting in a space between the reinforcing bulb and flange with contact between the bracket and the reinforcing bulb and contact between the bracket and the flange along an extended length of the bracket with essentially no ability to rotate perceptively relative to the grid runner and otherwise allow the grid runner to droop perceptively below its originally installed position.

2. A suspended ceiling grid as set forth in claim 1, wherein said grid runners support acoustical panels and are about 8 feet or greater in length.

3. A suspended ceiling grid as set forth in claim 1, wherein said channels are secured to wall studs with fasteners horizontally spaced from said second screws.

4. A suspended ceiling grid as set forth in claim 1, wherein said channel is roll formed sheet metal.

5. A suspended ceiling grid as set forth in claim 4, wherein said upper and lower flanges have inturned hems at their distal margins.

6. A suspended ceiling grid as set forth in claim 5, wherein said brackets have tabs proportioned to lock into said channels between said hems and said web.

7. A kit for constructing a narrow suspended ceiling for a corridor comprising a plurality of sheet metal runners, a plurality of sheet metal brackets, and a plurality of sheet metal channels, the runners having an upper reinforcing bulb and a lower flange and having a length of at least 8 feet, the brackets having first and second portions in a right angle configuration, the first portion having upper and lower edges lying on straight lines and proportioned to fit closely with the reinforcing bulb and flange of a runner when positioned against a runner, the lower edge lying on the respective straight line being the lowermost part of the first portion, directly engageable with the runner flange and extending along a distance greater than a distance between the upper edge and the lower edge, the channels having flanges joined by an intermediate web, the flanges having inturned hems at edges distal from the web, the bracket second portion having a tab proportioned to snap into engagement with an edge of a hem when the bracket second portion is positioned in the channel between the flanges and against the web.

* * * * *